US010604927B2

(12) United States Patent
Tobin et al.

(10) Patent No.: US 10,604,927 B2
(45) Date of Patent: Mar. 31, 2020

(54) PREROTATION BASIN FOR PUMPING FLUIDS FROM A WET WELL

(71) Applicant: Envirotech Pumpsystems, Inc., Salt Lake City, UT (US)

(72) Inventors: Eric Tobin, Ogden, UT (US); Matt Sheppick, Sanford, ME (US); David P. Borrowman, Murray, UT (US)

(73) Assignee: Trillium Pumps USA SLC LLC, Salt Lake City, UT (US)

( * ) Notice: Subject to any disclaimer, the term of this patent is extended or adjusted under 35 U.S.C. 154(b) by 0 days.

(21) Appl. No.: 16/054,480

(22) Filed: Aug. 3, 2018

(65) Prior Publication Data

US 2019/0048570 A1 Feb. 14, 2019

Related U.S. Application Data

(60) Provisional application No. 62/542,752, filed on Aug. 8, 2017.

(51) Int. Cl.
*E03F 5/10* (2006.01)
*E03F 5/22* (2006.01)

(52) U.S. Cl.
CPC ..... *E03F 5/108* (2013.01); *E03F 5/106* (2013.01); *E03F 5/22* (2013.01)

(58) Field of Classification Search
CPC .. E03F 5/22; E03F 5/106; E03F 5/108; Y10T 137/2109
See application file for complete search history.

(56) References Cited

U.S. PATENT DOCUMENTS

| | | | | |
|---|---|---|---|---|
| 1,529,634 A | | 3/1923 | Nagler | |
| 3,708,239 A | | 1/1973 | Stahle | |
| 4,298,294 A | | 11/1981 | Zimmerman | |
| 4,661,047 A | | 4/1987 | Weis | |
| 4,822,213 A | | 4/1989 | Grace et al. | |
| 4,827,961 A | * | 5/1989 | Nitzberg | B67D 7/3218 137/68.14 |
| 5,248,219 A | | 9/1993 | Heiler, Jr. | |
| 5,249,930 A | | 10/1993 | Pacquesi | |
| 5,303,782 A | * | 4/1994 | Johannessen | E03F 5/106 137/809 |

(Continued)

FOREIGN PATENT DOCUMENTS

| | | | |
|---|---|---|---|
| ES | 419686 A1 | | 4/1975 |
| JP | 0932098 | * | 2/1997 |
| JP | 09221820 | * | 8/1997 |

*Primary Examiner* — Carib A Oquendo
(74) *Attorney, Agent, or Firm* — Morriss O'Bryant Compagni Cannon PLLC

(57) ABSTRACT

A prerotation basin for use in a sump pit or wet well includes a basin body having an upstanding exterior wall, an interior concavity for placement of a pump inlet therein, and a fluid entry channel formed in the basin body defined by a discontinuity in the upstanding exterior wall, where the fluid entry channel has a channel floor, the threshold of which is at an elevation that is equal to or lower than the elevation of the bottom surface of the interior concavity. The prerotation basin thereby provides a channel floor that slopes upwardly toward the bottom surface of the interior concavity to provide better solids entrainment in fluid being processed from the sump pit or wet well, and to provide self-flushing of the basin.

24 Claims, 3 Drawing Sheets

(56) References Cited

U.S. PATENT DOCUMENTS

| | | | | |
|---|---|---|---|---|
| 5,419,655 | A | 5/1995 | Philips et al. | |
| 5,455,804 | A | 10/1995 | Holmes et al. | |
| 5,496,133 | A | 3/1996 | Sciarretti | |
| 5,507,628 | A | 4/1996 | Masse et al. | |
| 5,551,797 | A | 9/1996 | Sanford | |
| 5,687,766 | A | 11/1997 | Weakley | |
| 5,871,304 | A | 2/1999 | Quinn et al. | |
| 8,733,400 | B2 * | 5/2014 | Muggli ..... | B01D 3/008 137/561 A |
| 2005/0211611 | A1 | 9/2005 | Bazell et al. | |

* cited by examiner

PREROTATION BASIN FOR PUMPING FLUIDS FROM A WET WELL

CROSS-REFERENCE TO RELATED APPLICATION

This is a non-provisional application which claims priority to U.S. provisional patent application Ser. No. 62/542,752, filed Aug. 8, 2017, the contents of which are incorporated herein in their entirety.

TECHNICAL FIELD

This disclosure relates in general to basins used in the bottom of sump pits or wet wells to pump fluids therefrom. In particular, this disclosure relates to a prerotation basin that is structured to provide improved solids entrainment into the fluid being pumped, while maintaining fluid rotation capabilities.

BACKGROUND OF THE DISCLOSURE

Sump pits or wet wells are known and used in many industries to collect fluids at a site. A pump inlet is conventionally placed at the bottom of the sump pit or wet well to pump the fluids out of the sump pit or wet well. Many arrangements have been devised for facilitating the accumulation of fluids in a sump or wet well, and for pumping the fluids out of the sump or wet well.

Some arrangements comprise a tank into which a pump is lowered to pump fluids from the bottom of the tank. Other arrangements, which are particularly relevant to this disclosure, comprise the use or formation of a prerotation basin within a sump pit or wet well.

Prerotation basins are essentially comprised of a basin having an upper edge, which provides a weir, an internal bowl-like configuration into which a pump inlet is positioned, and a vertically-oriented entry slot formed generally along the side of the basin, at a tangential angle typically, to direct fluid into the internal bowl-like configuration. Fluid entering the bowl-like configuration through the slot is directed at an angle which causes the fluid to "prerotate" in the direction of rotation of the pump impeller, thus facilitating efficient fluid uptake.

The fundamental principle by which prerotation basins function is the establishment of an elevation difference between the liquid within the prerotation basin and liquid outside the prerotation basin. This is achieved by configuring the basin arrangement so that the entrance to the slot from the sump or wet well is at a higher elevation than the bottom of the bowl-like interior of the basin. That is, the entry point of the slot is placed at a higher elevation than the bottom of the interior of the prerotation basin to provide a downwardly sloping channel, which causes increased energy to be imparted to the fluid entering into the basin, thereby creating rotation of the fluid.

Notably, in conventional prerotation basin arrangements, the elevation differential is further achieved by the installation of the prerotation basin in the sump pit or wet well. That is, prerotation basins are provided in the bottom of the sump or wet well either by positioning a suitably shaped mold in the sump or wet well and pouring concrete about the mold to form the basin or, more typically, by placing a pre-cast three-dimensional basin form into the bottom of the sump or wet well and pouring concrete about the pre-cast form to complete the installation. In either case, concrete is poured into the sump pit or wet well to the level of the entry point of the slot. The required depth to which the prerotation basin must be set into place with concrete represents a very significant aspect of the cost of prerotation basin installation due to the amount of concrete required. Further, the addition of concrete to the sump pit or wet well also reduces the volume of water that the sump pit is capable of holding, which in turn requires more frequent on and off cycling of the pump that is installed in the sump pit.

In many industries, the fluid that is being pumped out of the sump pit or wet well contains solids, some of which tend to float to the top of the fluid, and others which are neutral and/or sinking. It is important that the solids be pumped out of the pit because solids that are not entrained in the fluid accumulate over time and eventually clog the basin, and may result in pumping inefficiencies or pump stoppage. Accumulated solids begin to become malodorous and may be toxic. Consequently, when solids accumulate to an unacceptable level, it is necessary to pull the pump from the basin and send workers into the basin to manually clean the solids from the basin. The manual removal of solids is costly and can be dangerous to the workers.

SUMMARY

In one aspect of the disclosure, embodiments are disclosed of a prerotation basin for use in a wet well, the prerotation basin including a basin body having a top edge and a base edge; an upstanding exterior wall extending between the top edge and base edge of the basin body; an interior concavity formed in the basin body, the interior concavity having a bottom surface and an interior wall that is continuous with the bottom surface of the interior concavity; and a fluid entry channel formed in the basin body defined by a discontinuity in the upstanding exterior wall of the basin body, the fluid entry channel extending from the top edge of the basin body to a channel floor, the channel floor beginning at a threshold point positioned at the upstanding exterior wall proximate the base edge and extending to the bottom surface of the interior concavity, wherein the threshold point of the channel floor is positioned at an elevation, relative to the base edge of the basin body, that is lower than the elevation of the bottom surface of the interior concavity relative to the base edge.

In certain embodiments, the channel floor of the fluid entry channel lies in a plane that is angled, relative to a plane defined by the base edge of the basin body, at between zero degrees and twenty degrees.

In some embodiments, the plane of the channel floor is angled at between one degree and nineteen degrees.

In other embodiments, the plane of the channel floor is angled at between two degrees and eighteen degrees.

In yet other embodiments, the plane of the channel floor is angled at between three degrees and seventeen degrees.

In still other embodiments, the plane of the channel floor is angled at between four degrees and sixteen degrees.

In some embodiments, the plane of the channel floor is angled at between five degrees and fifteen degrees.

In other embodiments, the plane of the channel floor is angled at between six degrees and fourteen degrees.

In yet other embodiments, the plane of the channel floor is angled at between seven degrees and thirteen degrees.

In still other embodiments, the plane of the channel floor is angled at between eight degrees and twelve degrees.

In still other embodiments, the plane of the channel floor is angled at between nine degrees and eleven degrees.

In some embodiments, the fluid entry channel is oriented tangentially to the interior wall of the interior concavity.

In certain other embodiments, the fluid entry channel further comprises two opposing upstanding walls each of which extends from the top edge of the basin body to the channel floor.

In yet another example, the one of the opposing upstanding walls of the fluid entry channel extends in length from a front face of the basin body to a terminal point located at and as part of the interior wall of the interior concavity, and wherein the length of the one opposing upstanding wall defines the length of the channel floor, as measured from the threshold point to the bottom surface of the interior concavity.

In certain embodiments, the length of the channel floor is between fourteen inches and twenty-six inches.

In some embodiments, the width of the fluid entry channel, measured as the distance between the two opposing upstanding walls at a point adjacent the interior concavity, is smaller than the width of the fluid entry channel between the two opposing upstanding walls as measured at the upstanding exterior wall of the basin body.

In other embodiments, the opposing upstanding wall of the fluid entry channel that extends in length from a front face of the basin body to a terminal point located at and as part of the interior wall of the interior concavity is parallel to the opposing upstanding wall of the fluid entry channel.

In still other embodiments, the width of the fluid entry channel, as measured between the two opposing upstanding walls at a point adjacent the threshold point, is equal to or smaller than the width of the fluid entry channel between the two opposing upstanding walls as measured at a point adjacent the top edge of the basin body.

In some embodiments, the width of the fluid entry channel, as measured between the two opposing upstanding walls at a point adjacent the threshold point, is greater than the width of the fluid entry channel measured between the two opposing upstanding walls at a point adjacent the top edge of the basin body.

In yet other embodiments, the threshold point of the fluid entry channel extends above the base edge of the basin body a distance of between zero inches and 4.5 inches.

In certain other embodiments, the bottom surface of the interior concavity extends above a plane defined by the base edge of the basin body between four inches and four and one half inches.

In some embodiments, the basin body includes a crenelated notch formed in the basin body that extends downwardly from the top edge and provides a shoulder surface for use in attaching thereto a part of a fast out arrangement.

In still other embodiments, the crenelated notch is oriented generally opposite the fluid entry channel.

Other aspects, features, and advantages will become apparent from the following detailed description when taken in conjunction with the accompanying drawings, which are a part of this disclosure and which illustrate, by way of example, principles of the various embodiments disclosed.

DESCRIPTION OF THE FIGURES

The accompanying drawings facilitate an understanding of the various embodiments, in which.

DETAILED DESCRIPTION

Figure 1:
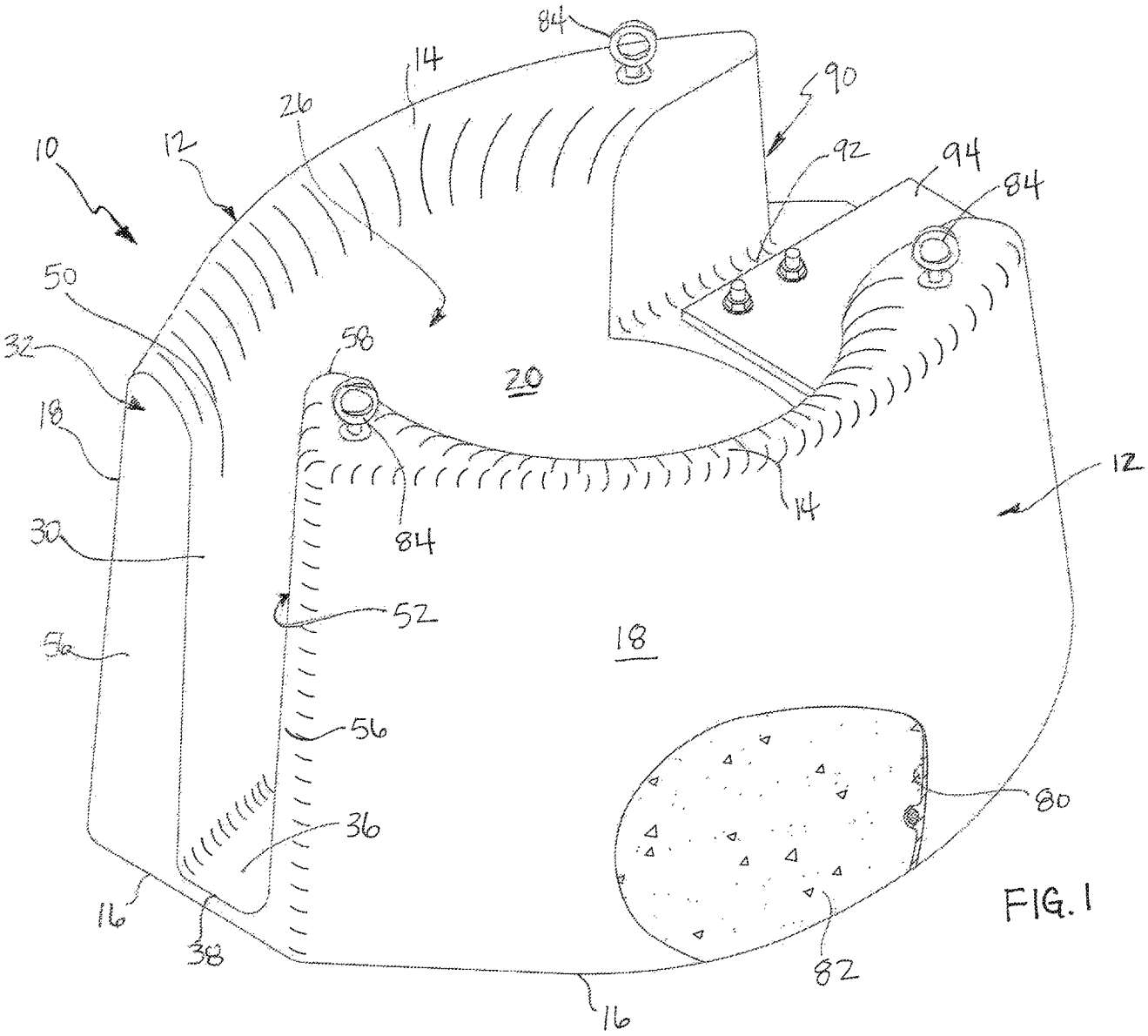
FIG. 1 is a perspective view, in partial cutaway, of an example of the prerotation basin in accordance with this disclosure.
Figure 2:
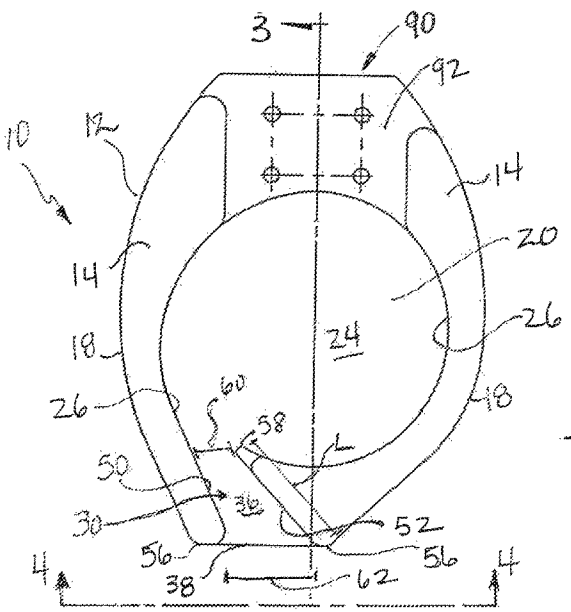
FIG. 2 is a plan view of the example of the prerotation basin depicted in accordance with the disclosure.

FIG. 1 depicts an example of a prerotation basin 10 in accordance with the disclosure. The prerotation basin 10 includes a basin body 12 having a top edge 14 and a base edge 16, and an upstanding exterior wall 18 that extends between the top edge 14 and the base edge 16 of the basin body 12. An interior concavity 20 is formed in the basin body 12 and is generally defined by the upstanding exterior wall 18 that surrounds the interior concavity 20. The interior concavity 20, as best seen in FIGS. 2 and 3, has a bottom surface 24 and an interior wall 26 that is continuous with the bottom surface 24 of the interior concavity 20.

A fluid entry channel 30 is formed in the basin body 12 and is defined by a discontinuity in the surrounding upstanding exterior wall 18 of the basin body 12 to provide an open slot 32. The open slot 32 of the fluid entry channel 30, in accordance with the disclosure, extends from the top edge 14 of the basin body 12, where the slot 32 is open, to a channel floor 36. The channel floor 36 begins at a threshold point 38 positioned at the upstanding exterior wall 18 proximate the base edge 16, and extends inwardly toward the interior concavity 20 to conjoin with the bottom surface 24 of the interior concavity 20.

Figure 3:
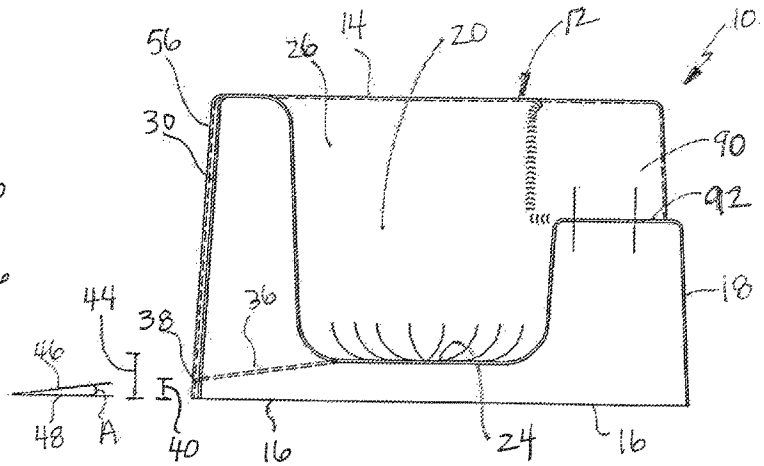
FIG. 3 is an elevated view in cross section of the prerotation basin depicted in FIG. 2, taken at line 3-3.

The threshold point 38 of the channel floor 36 is positioned at an elevation 40, relative to the base edge 16 of the basin body 10, which is lower than the elevation 44 of the bottom surface 24 of the interior concavity 20, relative to the base edge 16, as shown in FIG. 3. The threshold point 38 of the fluid entry channel 30 extends above the base edge 16 of the basin body 12 a distance of between 0.25 inches and 4.5 inches, depending on the size of the prerotation basin 10. The bottom surface 24 of the interior concavity 20 extends above a plane 48, defined by the base edge 16 of the basin body 12, between four inches and 4.5 inches. In any given size of the basin body 12, the threshold point 38 is never at an elevation 40 that is greater than the elevation 44 of the bottom surface 24, and the channel floor 36 is upwardly angled toward the bottom surface 24 of the interior cavity 20. In some embodiments, however, the elevation 40 of the threshold point may be equal to the elevation 44 of the bottom surface 24.

As seen in FIG. 3, the channel floor 36 of the fluid entry channel 30 lies in a plane 46 that is angled, relative to the plane 48 defined by the base edge 16, or in which the base edge 16 lies. The angle A of the channel floor 36, relative to the base edge 16, as defined by planes 46 and 48, can be from between zero degrees and twenty degrees, depending on the size of the prerotation basin 10. Consequently, the plane 46 of the channel floor 36 may be angled at between one degree and nineteen degrees in some sizes of the prerotation basin. The plane 46 of the channel floor 36 may be angled at between two degrees and eighteen degrees in other sizes of the prerotation basin. The plane 46 of the channel floor 36 may be angled at between three degrees and seventeen degrees in certain other sizes of the prerotation basin, or between four degrees and sixteen degrees, or between five degrees and fifteen degrees, or between six degrees and fourteen degrees, or between seven degrees and thirteen degrees, or even between eight degrees and twelve degrees, in various sizes of the basin body 12. A suitable angle may be approximately nine degrees to eleven degrees. The angle of the plane 46 may be zero degrees or one degree or two degrees or three degrees or four degrees or five degrees or six degrees or seven degrees or eight degrees or nine degrees or ten degrees or eleven degrees or twelve degrees or thirteen degrees or fourteen degrees or fifteen degrees or sixteen degrees or seventeen degrees or eighteen degrees or nineteen degrees or twenty degrees.

A comprehensive entrainment of solids into the fluid is achieved by lowering the threshold point 38 of the fluid entry channel 30 to an elevation at or below the bottom surface 24 of the interior concavity 20, which is counterintuitive to conventional prerotation basins in which the conventional concept is to raise the entry point of the fluid channel well above the elevation of the bottom surface of the basin in order to produce as much energy as possible in the entering fluid, thereby initiating robust fluid rotation and entrainment of solids into the fluid.

However, reducing the elevation of the threshold point 38 of the fluid entry channel 30 not only produces excellent solids entrainment, but does not sacrifice the ability of the basin body design to facilitate prerotation of the entering fluid. The low elevation threshold point 38 and upward sloping channel, or level channel, enable the prerotation basin 10 of the disclosure to operate in a manner comparable to conventional prerotation basin designs.

In use, a pump is positioned with the pump outlet oriented toward the bottom surface 24 of the basin. When the pump is shutting down, the fluid in the discharge pipe and pump casing will flow backward through the prerotation basin, exiting through the fluid entry channel 30. The motion of the fluid flowing backward through the fluid entry channel 30 down the negative or level slope of the plane 46 will flush and drain the prerotation basin, further enhancing the self-cleaning capability of the prerotation basin.

The ability of the prerotation basin 10 of the present disclosure to improve solids entrainment while still facilitating prerotation of the entering fluid is further achieved through particular design of the fluid entry channel 30. The fluid entry channel 30 of the disclosure is oriented tangentially to the interior wall 26 of the interior concavity 20. However, the open fluid entry channel 30 is designed differently from conventional prerotation basins.

In accordance with the disclosure, the open fluid entry channel 30 comprises two opposing upstanding walls 50, 52, that face each other, each of which extends from the top edge 14 of the basin body 12 to the channel floor 36, as shown in FIGS. 2, 4, 5 and 6. One of the opposing upstanding walls 52 of the fluid entry channel 30 extends in length from a front face 56 of the basin body 12 at the upstanding exterior wall 18 to a terminal point 58 located at, and as part of, the interior wall 26 of the interior concavity 20. The length of the one opposing upstanding wall 52 defines the length L of the channel floor 36, as measured from the threshold point 38 to the bottom surface 24 of the interior concavity 20 where the channel floor 36 conjoins with the bottom surface 24. The length L of the channel floor 36 is between fourteen inches and twenty-six inches, depending on the size of the prerotation basin. In some embodiments, the length L may be between thirteen inches and twenty-five inches, or may be between twelve inches and twenty-four inches, or may be between eleven inches and twenty-three inches, or may be between ten inches and twenty-two inches, or may be between nine inches and twenty-one inches, or may be between eighth inches and twenty inches, or may be between seven inches and nineteen inches, or shorter. The length L of the channel floor 36 is less than the length of the channel floor of conventional prerotation basins that have a downward slope from the entry channel into the bottom of the basin.

The shape and dimensions of the fluid entry channel 30 play a further role in the unexpected operability of the prerotation basin 10 of the disclosure. The width 60 of the fluid entry channel 30, measured as the distance between the two opposing upstanding walls 50, 52 at a point adjacent the interior concavity 20, is smaller than the width 62 of the fluid entry channel 30 between the two opposing upstanding walls 50, 52, as measured at the upstanding exterior wall 18 of the basin body 12. The widths 60, 62 will vary depending on the size of the prerotation basin. In some embodiments, the ratio of the width 60 to the width 62 is generally between 1:2 and 1:4 or, in other embodiments, between 1:2 and 1:3.

Figure 7:
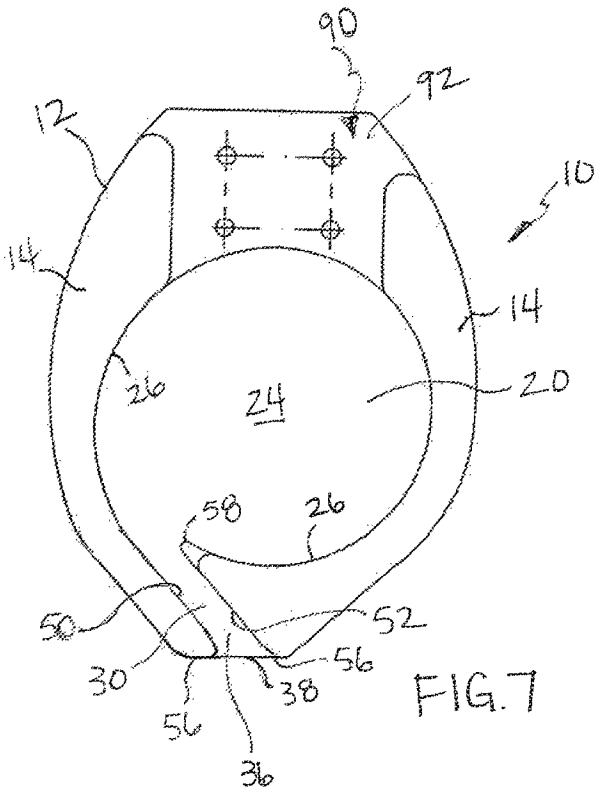
FIG. 7 is a plan view of an alternative example of the prerotation basin in accordance with the disclosure.

In some embodiments, the one opposing upstanding wall 52 of the fluid entry channel 30 that extends in length from the front face 56 of the basin body 12 to the terminal point 58 located at the interior wall 26 of the interior concavity 20 is parallel to the opposing upstanding wall 50 of the fluid entry channel 30, as depicted in FIG. 7. Again, the measured distance or width between the two opposing upstanding walls 50, 52 varies depending on the size of the prerotation basin 10, but may be between two inches and fifteen inches.

Figure 4:
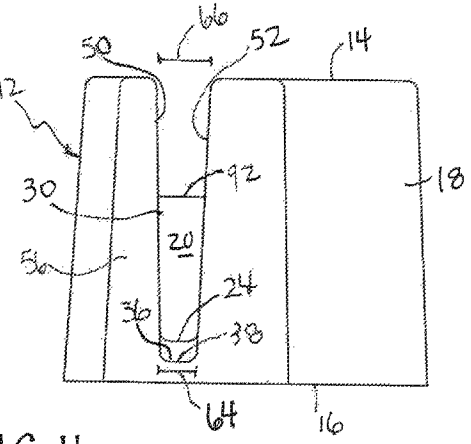
FIG. 4 is a view in elevation of the prerotation basin depicted in FIG. 2, taken at line 4-4.

In some embodiments, the width of the fluid entry channel 30 as measured between the two opposing upstanding walls 50, 52 at a point adjacent the threshold point 38 is equal to or smaller than the width of the fluid entry channel 30 measured between the two opposing upstanding walls 50, 52 at a point adjacent the top edge 14 of the basin body 12. As shown in FIG. 4, the width 64 of the fluid entry channel 30 measured between the two opposing upstanding walls 50, 52 at the threshold point 38 is smaller than the width 66 of the fluid entry channel 30 between the two opposing upstanding walls 50, 52 as measured at a point adjacent the top edge 14 of the basin body 12.

Figure 5:
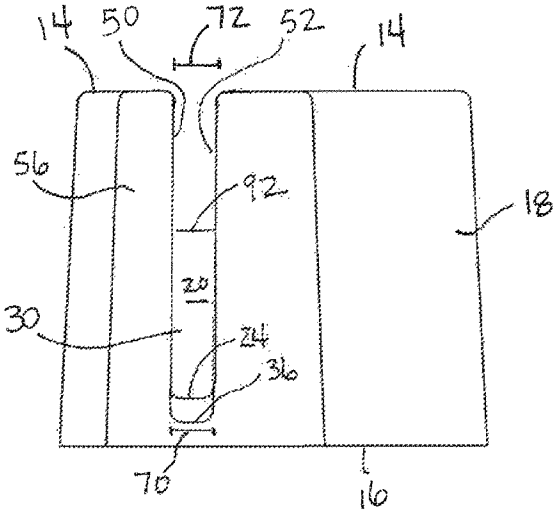
FIG. 5 is a view in elevation of a further example of the prerotation basin in accordance with the disclosure in which the fluid entry slot is modified in configuration.

In an alternative embodiment shown in FIG. 5, the width 70 of the fluid entry channel 30 measured between the two opposing upstanding walls 50, 52 at the threshold point 38 may be equal to, or close to, the width 72 of the fluid entry channel 30 between the two opposing upstanding walls 50, 52 as measured at a point adjacent the top edge 14 of the basin body 12.

Figure 6:
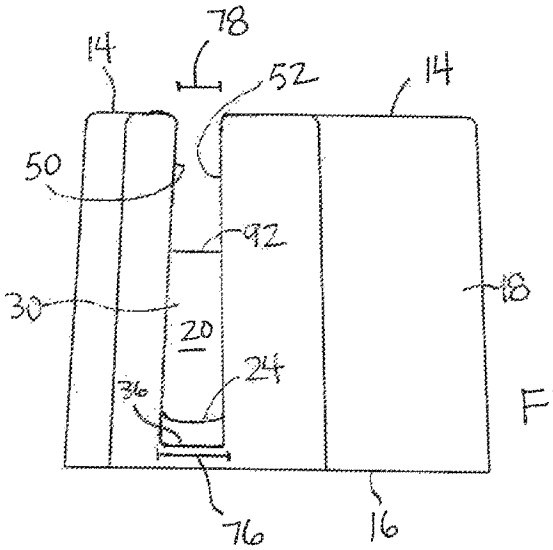
FIG. 6 is a view in elevation of another example of the prerotation basin in accordance with the disclosure in which the fluid entry slot is modified in configuration.

In another example shown in FIG. 6, the width 76 of the fluid entry channel 30 measured between the two opposing upstanding walls 50, 52 at the threshold point 38 is greater than the width 78 of the fluid entry channel 30 between the two opposing upstanding walls 50, 52 as measured at a point adjacent the top edge 14 of the basin body 12. The exact dimension and configuration of the fluid entry channel 30 in any given example is selected to provide entry of solids, either previously entrained or floating, into the interior concavity 20 of the prerotation basin 10.

Additional structural features of the prerotation basin 10 include, as seen in FIG. 1, a space 80 that is formed between the upstanding exterior wall 18 and the interior wall 26 of the interior concavity 20. The space 80 can be filled with ballasting 82 and/or structural reinforcement, such as concrete or any other suitable ballasting material, to aid in anchoring the prerotation basin 10 to the bottom of a wet well or sump. Typically, before installation of the prerotation basin 10 in the sump or wet well, the basin body 12 is inverted to position the base edge 16 in an upward orientation and a quantum of ballasting 82 is placed in the space 80. After the ballasting has cured or been secured in position, the prerotation basin 10 is then inverted again and lowered into the wet well or sump with the base edge oriented downwardly. The prerotation basin 10 may have at least three lifting eyes 84 positioned in proximity to the top edge 14 of the basin body 12 to provide means for lifting the prerotation basin 10 into and out of the wet well or sump.

An additional feature of the prerotation basin 10 of the disclosure comes with the fact that the threshold point 38 is at a low elevation 40 relative to the base edge 16, and once the prerotation basin 10 is positioned in the sump or wet well, only a small amount of concrete is required to be poured into the sump or wet well to anchor the prerotation basin 10 in place. That is, only a few inches of concrete need to be poured into the sump or wet well around the basin body 12 to bring the level of concrete up to the level of the threshold point 38, as compared to several inches or feet of concrete that are required to be poured with conventional prerotation basins in order to bring the level of concrete up to the elevated level of the entry point in downwardly sloping fluid channels. In some installations of the prerotation basin 10 of the disclosure, pouring concrete into the sump pit or wet well may not be necessary. Consequently, the design of the prerotation basin 10 of the disclosure provides significant cost savings in the installation over conventional prerotation basins because of the reduced or eliminated need for concrete.

The prerotation basin 10 further includes a crenelated notch 90 formed in the basin body 12 that extends downwardly from the top edge 14 of the basin body 12 and provides a shoulder surface 92 for use in attaching a part of a fast out arrangement thereto, as is known in the industry. In FIG. 1, a plate 94 is shown secured to the shoulder surface 92 by a plurality of bolts. A fast out arrangement can be secured to the plate 94, or can be secured to the shoulder surface 92 without use of the plate 94.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left," "right," "front," "rear," "above" and "below," and the like, are used as words of convenience to provide reference points and are not to be construed as limiting terms.

In this specification, the word "comprising" is to be understood in its "open" sense; that is, in the sense of "including" and, thus, not limited to its "closed" sense, that is, in the sense of "consisting only of." A corresponding meaning is to be attributed to the corresponding words "comprise," "comprised" and "comprises" where they appear.

In addition, the foregoing describes only some embodiments, and alterations, modifications, additions and/or changes that can be made thereto without departing from the scope and spirit of the disclosed embodiments, the embodiments being illustrative and not restrictive.

Furthermore, embodiments have been described in connection with the disclosure and it is to be understood that the disclosed embodiments are not to be limited to that described herein; but to the contrary, are intended to cover various modifications and equivalent arrangements included within the spirit and scope of the what is described herein. Also, the various embodiments described above may be implemented in conjunction with other embodiments, e.g., aspects of one example may be combined with aspects of another example to realize yet other embodiments. Further, each independent feature or component of any given assembly may constitute an additional example.

What is claimed is:

1. A prerotation basin for use in a wet well, comprising:

a basin body having a top edge and a base edge;

an upstanding exterior wall extending between the top edge and base edge of the basin body;

an interior concavity formed in the basin body, the interior concavity having a bottom surface and an interior wall that is continuous with the bottom surface of the interior concavity; and a fluid entry channel formed in the basin body defined by a discontinuity in the upstanding exterior wall of the basin body, the fluid entry channel extending from the top edge of the basin body to a channel floor, the channel floor beginning at a threshold point positioned at the upstanding exterior wall of the basin body proximate the base edge and extending to the bottom surface of the interior concavity, wherein the threshold point of the channel floor is positioned at an elevation, relative to the base edge of the basin body, which is lower than the elevation of the bottom surface of the interior concavity relative to the base edge.

2. The prerotation basin of claim 1, wherein the channel floor of the fluid entry channel lies in a plane that is angled, relative to a plane defined by the base edge of the basin body, at between zero degrees and twenty degrees.

3. The prerotation basin of claim 2, wherein the plane of the channel floor is angled at between one degree and nineteen degrees.

4. The prerotation basin of claim 2, wherein the plane of the channel floor is angled at between two degrees and eighteen degrees.

5. The prerotation basin of claim 2, wherein the plane of the channel floor is angled at between three degrees and seventeen degrees.

6. The prerotation basin of claim 2, wherein the plane of the channel floor is angled at between four degrees and sixteen degrees.

7. The prerotation basin of claim 2, wherein the plane of the channel floor is angled at between five degrees and fifteen degrees.

8. The prerotation basin of claim 2, wherein the plane of the channel floor is angled at between six degrees and fourteen degrees.

9. The prerotation basin of claim 2, wherein the plane of the channel floor is angled at between seven degrees and thirteen degrees.

10. The prerotation basin of claim 2, wherein the plane of the channel floor is angled at between eight degrees and twelve degrees.

11. The prerotation basin of claim 2, wherein the plane of the channel floor is angled at between nine degrees and eleven degrees.

12. The prerotation basin of claim 1, wherein the fluid entry channel is oriented tangentially to the interior wall of the interior concavity.

13. The prerotation basin of claim 1, wherein the fluid entry channel further comprises two opposing upstanding walls each of which extends from the top edge of the basin body to the channel floor.

14. The prerotation basin of claim 13, wherein one of the opposing upstanding walls of the fluid entry channel extends in length from a front face of the basin body to a terminal point located at and as part of the interior wall of the interior concavity, and wherein the length of the one opposing upstanding wall defines the length of the channel floor, as measured from the threshold point to the bottom surface of the interior concavity.

15. The prerotation basin of claim 14, wherein the length of the channel floor is between fourteen inches and twenty-six inches.

16. The prerotation basin of claim 14, wherein the width of the fluid entry channel, measured as the distance between the two opposing upstanding walls at a point adjacent the interior concavity, is smaller than the width of the fluid entry channel between the two opposing upstanding walls as measured at the upstanding exterior wall of the basin body.

17. The prerotation basin of claim 14, wherein the opposing upstanding wall of the fluid entry channel that extends in length from a front face of the basin body to a terminal point located at the interior wall of the interior concavity is parallel to the opposing upstanding wall of the fluid entry channel.

18. The prerotation basin of claim 13, wherein the width of the fluid entry channel, as measured between the two opposing upstanding walls at a point adjacent the threshold point, is equal to or smaller than the width of the fluid entry channel measured between the two opposing upstanding walls at a point adjacent the top edge of the basin body.

19. The prerotation basin of claim 13, wherein the width of the fluid entry channel, as measured between the two opposing upstanding walls at a point adjacent the threshold point, is greater than the width of the fluid entry channel measured between the two opposing upstanding walls as measured at a point adjacent the top edge of the basin body.

20. The prerotation basin of claim 1, wherein the threshold point of the fluid entry channel extends above the base edge of the basin body a distance of between 0.25 inches and 4.5 inches.

21. The prerotation basin of claim 1, wherein the bottom surface of the interior concavity extends above a plane defined by the base edge of the basin body between four inches and 4.5 inches.

22. The prerotation basin of claim 1, further comprising a crenelated notch formed in the basin body that extends downwardly from the top edge and provides a shoulder surface for use in attaching a part of a fast out arrangement thereto.

23. The prerotation basin of claim 22, wherein the crenelated notch is oriented generally opposite the fluid entry channel.

24. The prerotation basin of claim 1, further comprising at least three lifting eyes positioned in proximity to the top edge of the basin body.

* * * * *